US009456682B2

(12) United States Patent
Taylor

(10) Patent No.: US 9,456,682 B2
(45) Date of Patent: Oct. 4, 2016

(54) DRILL-POWERED BRUSH WITH ELECTRICAL SHOCK PROTECTION AND LONG REACH FUNCTIONALITY

(71) Applicant: Wade Taylor, The Pas (CA)

(72) Inventor: Wade Taylor, The Pas (CA)

( * ) Notice: Subject to any disclaimer, the term of this patent is extended or adjusted under 35 U.S.C. 154(b) by 275 days.

(21) Appl. No.: 14/475,963

(22) Filed: Sep. 3, 2014

(65) Prior Publication Data

US 2016/0058169 A1 Mar. 3, 2016

(51) Int. Cl.

| | |
|---|---|
| ***A46B 13/02*** | (2006.01) |
| ***B08B 1/04*** | (2006.01) |
| ***A46B 5/00*** | (2006.01) |
| ***A46B 13/00*** | (2006.01) |
| ***B08B 1/00*** | (2006.01) |

(52) U.S. Cl.

CPC ..... *A46B 13/02* (2013.01); *A46B 5/0095* (2013.01); *A46B 13/001* (2013.01); *B08B 1/002* (2013.01); *B08B 1/04* (2013.01)

(58) Field of Classification Search

CPC ..... A46B 13/00; A46B 13/02; B08B 1/002; B08B 1/04

USPC ..... 15/21.1, 23, 52.1, 104.095

See application file for complete search history.

(56) References Cited

U.S. PATENT DOCUMENTS

| | | | | |
|---|---|---|---|---|
| 1,468,219 | A | 9/1923 | Snazelle et al. | |
| 2,866,212 | A | 12/1958 | White et al. | |
| 3,293,680 | A | 12/1966 | Wilson et al. | |
| 3,430,279 | A * | 3/1969 | Hintze | B24B 23/02 15/23 |
| 6,295,681 | B1 | 10/2001 | Dolah | |
| 6,374,447 | B1 | 4/2002 | Armbruster et al. | |
| 6,553,601 | B1 | 4/2003 | Major | |
| 7,958,587 | B1 | 6/2011 | Hansen | |
| 7,971,310 | B2 | 7/2011 | Metaxatos et al. | |
| 8,024,995 | B2 | 9/2011 | Dayton et al. | |

(Continued)

FOREIGN PATENT DOCUMENTS

| | | |
|---|---|---|
| DE | 10124885 | * 12/2002 |
| JP | 2005-40730 | * 2/2005 |

OTHER PUBLICATIONS

Ankush Kumar, Motorised cob web, pick pocket alarm and other ideas, http://www.nif.org.in/upload/pdg_file/motorised_cob.pdf.

(Continued)

*Primary Examiner* — Mark Spisich

(74) *Attorney, Agent, or Firm* — Kyle R. Satterthwaite; Ryan W. Dupuis; Ade & Company Inc.

(57) ABSTRACT

A drill-powered rotational brush apparatus features an electrically non-conductive tubular housing, and a metal input shaft rotatably supported in the housing has an external end reaching out from the housing for engagement in the chuck of the drill. A connection is provided between an internal end of the metal input shaft and a brush whose radial bristles reside externally of the housing at the second end thereof. The connection features an electrical insulator that electrically isolates the metal input shaft from the brush and any portion of the connection that lies externally of the tubular housing beyond the second end thereof, thereby protecting the user form the risk of electrical shock. The connection end of the brush matches the cross-sectional size and peripheral shape of the external end of the input shaft to allow coupling together of two like apparatuses to collectively form a longer brush assembly.

20 Claims, 2 Drawing Sheets

(56) References Cited

U.S. PATENT DOCUMENTS

| | | | | |
|---|---|---|---|---|
| 8,166,665 | B2 | 5/2012 | Potgeter et al. | |
| 8,256,056 | B2 | 9/2012 | Jones | |
| 8,752,227 | B2 * | 6/2014 | Manning | A47L 13/38 15/144.3 |
| 2005/0172437 | A1 | 8/2005 | Wachter | |
| 2008/0047085 | A1 | 2/2008 | Kolarevic et al. | |

OTHER PUBLICATIONS

Web Spinner Spider Web Remover, http://www.bugspraycart.com/equipment/tools.web-spinner/.

* cited by examiner

DRILL-POWERED BRUSH WITH ELECTRICAL SHOCK PROTECTION AND LONG REACH FUNCTIONALITY

FIELD OF THE INVENTION

The present invention relates generally to rotationally driven brushes, and more particularly to a drill-powered brush design providing electrical shock protection and long reach capabilities useful during cleaning operations, such as the removal of spider webs or the like from the exterior of buildings or other structures.

BACKGROUND

It has been previously proposed to use motor-driven rotation of a brush to clean up spider webs, whereby the webs are effectively wound onto the rotating brush for thorough removal of same from interior or exterior walls or corners of a home or other building. On such device featuring a batter operated motor with a soft plastic brush can be seen at http://www.nif.org.in/upload/pdf_file/motorised-_cob.pdf. A similar device with a spinning head for winding up spider webs can be seen at http://www.bugspraycart.com/equipment/tools/web-spinner/.

Other examples of rotating brushes or cleaning devices driven by dedicated on-board motors or a separate power source such as a conventional cordless hand drill can be found in U.S. Patent Application Publications 2005/0172437 and 2008/0047085, and U.S. Pat. Nos. 1,468,219; 2,866,212; 3,293,680; 6,295,681; 6,374,447; 6,553,601; 7,958,587; 7,971,310; 8,024,995; 8,166,665 and 8,256,056.

However, applicant has developed a new design of a drill-powered rotational brush apparatus suitable that provides improved safety against electrical shock while cleaning spider webs near electrical wiring, equipment or appliances, while providing a robust durable product with notable long-reach functionality, for example useful while cleaning the exterior of a two-storey home or other building or structure of notable size.

SUMMARY OF THE INVENTION

According to one aspect of the invention there is provided a rotational brush apparatus arranged for driven operation by a hand drill, the apparatus comprising:

an electrically non-conductive tubular housing having opposing first and second ends spaced apart in a longitudinal direction and a hollow interior space spanning between said first and second ends and bound by a circumferential wall;

a metal input shaft lying in the longitudinal direction and reaching into the hollow interior space of the tubular housing from the first end thereof to place an internal end of said metal input shaft inside the tubular housing, while leaving an external end of the metal input shaft exposed outside the tubular housing beyond the first end thereof for engagement in a chuck of the hand drill, the metal input shaft shaft being rotatably supported within the tubular housing;

a brush comprising a central core lying parallel to, and in alignment with, the metal input shaft, with bristles of the brush radiating outwardly from said central core at locations outside the tubular housing beyond the second end thereof;

a connection between the metal input shaft and the central core of the brush to cause rotation of the brush with the metal input shaft under driven rotation thereof by the hand drill, the connection being disposed at least partially within the interior space of the tubular housing and comprising an electrical insulator that electrically isolates the metal input shaft from the brush and from any metal portion of the connection that lies externally of the tubular housing beyond the second end thereof.

Preferably the electrical insulator resides at an intermediate location along the tubular housing that is spaced from the second end thereof.

Preferably the electrical insulator resides nearer to a longitudinal mid-point of the tubular housing than to the second end thereof.

Preferably the connection comprises a second metal shaft lying parallel to, and in alignment with, the metal input shaft at a position lying beyond the internal end thereof and reaching toward the second end of the tubular housing, the second metal shaft being rotatably supported within said tubular housing and being coupled to the metal input shaft via the electrical insulator.

Preferably at least a majority of the second metal shaft is contained within the tubular housing.

Preferably the electrical insulator comprises a sleeve of electrically insulative material having one end thereof fitted over the internal end of the metal input shaft.

Preferably a second end of the sleeve is fitted over a respective end of a metal component of the connection, preferably the second metal shaft, which is spaced apart from the input shaft in the longitudinal direction.

Preferably the connection comprises a chuck arranged for selective detachment and reattachment of the brush thereto.

Preferably the chuck is arranged to enable selective connection thereof to the external end of the metal input shaft of a matching second rotational brush apparatus when the brush is detached from the chuck.

Preferably the external end of the metal input shaft and a connection end of the brush by which the brush attaches to the chuck have a matching peripheral shape.

Preferably the external end of metal input shaft and the connection end of the brush have a matching cross-sectional size.

Preferably the chuck comprises metal and is disposed externally of the tubular housing, and the electrical insulator electrically isolates the chuck from the metal input shaft.

Preferably the central core of the brush comprises metal, for example twisted metal wire.

According to a second aspect of the invention, there is provided a rotational brush apparatus arranged for driven operation by a hand drill, the apparatus comprising:

a tubular housing having opposing first and second ends spaced apart in a longitudinal direction and a hollow interior space spanning between said first and second ends and bound by a circumferential wall;

an input shaft lying in the longitudinal direction and reaching into the hollow interior space of the tubular housing from the first end thereof to place an internal end of said input shaft inside the tubular housing, while leaving an external end of the input shaft exposed outside the tubular housing beyond the first end thereof for engagement in a chuck of the hand drill, the input shaft being rotatably supported within the tubular housing;

a brush comprising a central core and bristles radiating outwardly therefrom;

chuck connected to the input shaft for rotation therewith at or adjacent the second end of the tubular housing, the chuck being arranged for selective attachment and detachment to and from an end of the brush, as well as selective attachment and detachment to and from the external end of the input shaft of a second matching rotational brush apparatus.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
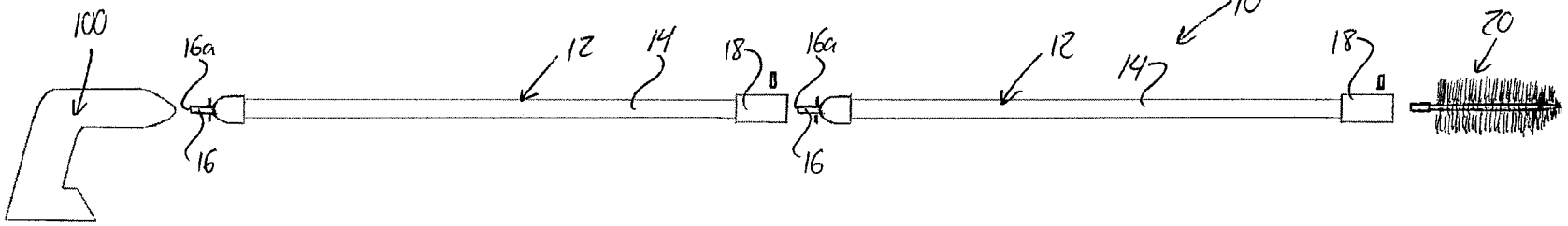
FIG. 1 is an exploded side elevational view illustrating use of shaft assemblies from two rotatable brush devices of the present invention to form an extended-length rotatable brush driven by a cordless hand drill.

FIG. 1 illustrates one possible mode of use of the present invention, wherein components from two rotatable brush devices are assembled together to collectively form an assembled brush device of increased axial length, useful for example in cleaning spider webs or the like from interior ceiling corners, or exterior wall corners or overhangs of a building. Each brush device 10 features a shaft assembly 12 having a generally cylindrical tubular outer housing 14 formed of a relatively rigid plastic or other electrically insulative material, a metal input shaft 16 having an exposed external end 16*a* situated outside the housing 14 a short distance beyond a first end thereof and otherwise residing internally of the housing 14, and a metal chuck 18 that is disposed externally of the tubular housing 14 at an opposing second thereof and is connected to the input shaft 16 in a manner rotatable therewith. The exposed external end 16*a* of the input shaft 16 of either brush assembly is engagable in either the chuck 18 of the shaft assembly 12 of another brush device of the same type, or in the chuck of a hand drill, such as the cordless battery-powered drill 100 schematically shown in FIG. 1. Accordingly, the two shaft assemblies 12 of FIG. 1 can be coupled together in series with one another and with the cordless drill 100 likewise coupled to one of the shaft assemblies 12, whereby engagement of a radially bristled brush 20 into the chuck 18 of the other shaft assembly forms an overall brush assembly that is nearly twice the length of one of the brush devices would be alone if its individual shaft assembly 12 was coupled directly between the drill 100 and the brush 20.

Figure 2:
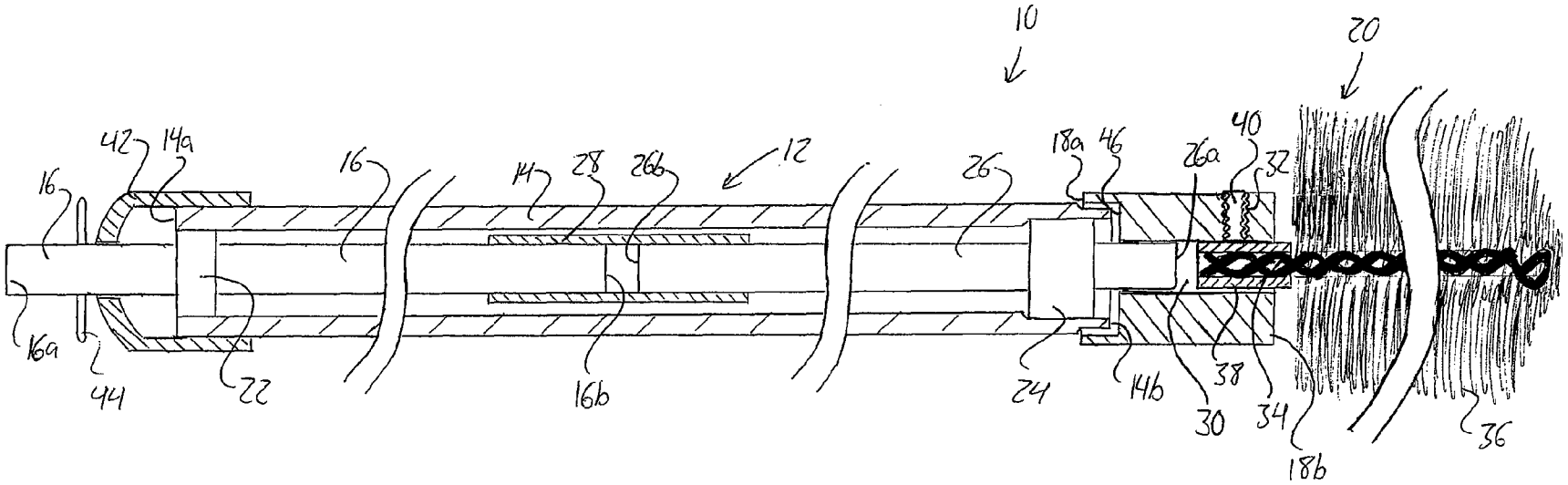
FIG. 2 is a cross-sectional view one of the rotatable brush devices of FIG. 1.

More detail of the particular structure of the shaft assembly 12 of each brush device 10 is revealed in the cross-sectional view of one of these brush devices 10 in FIG. 2. The tubular housing 14 has a hollow interior spanning the full axial length thereof from the first end 14*a* of the housing 14 to the longitudinally opposite second end 14*b*. A first bushing or bearing 22 is fitted within the first end 14*a* of the housing 14, and a second bushing or bearing 24 is likewise fitted within the housing 14 at the opposing second end 14*b* thereof. The input shaft 16 has a length slightly exceeding half of that of the tubular housing 14, and a substantial majority of the input shaft's length resides within the hollow interior space of the housing 14. Accordingly, at an approximate halfway point along the axial length the housing 14, the input shaft terminates at an internal end 16*b*. Where it reaches into the housing 14 at the first end 14*a* thereof, the input shaft 16 passes through the first bushing or bearing 22, whereby the input shaft 16 is rotatably supported within the housing 14 for rotation relative thereto about a central longitudinal axis shared by the housing 14 and the input shaft 16 lying concentrically therein.

A second metal shaft 26 has a respective external end 26*a* disposed outside the tubular housing 14 a short axial distance beyond the second end 14*b* thereof, from which the second shaft 26 reaches into the hollow interior space of the tubular housing 14 and toward the internal end 16*b* of the input shaft 16. Like the input shaft, the second shaft 26 has length that slightly exceeds half of that of the tubular housing 14, and a substantial majority of the second shaft's length is received within the tubular housing 14. The second shaft 26 stops short of reaching the internal end 16*b* of the input shaft 16, and thus has an internal end 26*b* spaced a short axial distance from the adjacent internal end 16*b* of the input shaft at a location near the lengthwise center of the tubular housing 14. These adjacent internal ends of the two metal shafts 16, 26 are coupled together by a sleeve 28 of plastic or other electrically insulative material. This sleeve shaped electrical insulator 28 respectively receives the internal ends 16*b*, 26*b* of the two shafts 16, 26 in the two open ends of the sleeve 28, whereby the two shafts 16, 26 are secured together for rotation as one, and are maintained in the axially separated condition leaving the gap or space between them inside the sleeve 28. The connection between the sleeve and the shafts may rely on a friction fit therebetween, use of an adhesive layer between the sleeve and each shaft, a combination thereof, or other suitable fastening means. The axial space between the two metal shafts may optionally be filled with a volume of electrically insulative material to further prevent electrically conductive contact between the two shafts, although as described herein further below, other means for preventing contact between the internal shaft ends may be additionally or alternatively employed.

The gap between the two shafts is sufficient short such that any flexibility that may be present in the sleeve at this gap is sufficiently low so to maintain substantial concentric axial alignment between the two shafts 16, 26, thereby cooperating with the bushings or bearings 22, 24 to maintain the two shafts in generally concentric alignment with the surrounding tubular housing 14. Prototypes of the invention have employed commercially available flexible PVC tubing with nylon braid reinforcement as the insulating sleeve 28, but it will be appreciated that other materials may be employed so long as the tubular housing has sufficient rigidity to maintain its generally cylindrical shape closing circumferentially around the internal shafts 16, 26. The outer housing 14 serves as a manual handle by which the device 10 is carried and held. The outer housing spans a substantial majority of the total collective axial length spanned by the two internal shafts 16, 26 and the sleeve shaped insulator coupling 28 therebetween, for example spanning more than 75% of this collective internal shaft length, and preferably more than 80% thereof, for example approximately 90% of the internal shaft length in one embodiment. Accordingly, the brush device 10 can be gripped with two hands at any number of locations spread out over a wide range of the overall length of the device 10.

The radial space maintained by the bushings or bearings 22, 24 between the inner surface of the tubular housing's circumferential wall and the internal shafts 16, 26 housed therein exceeds the wall thickness of the sleeve 28, whereby sufficient clearance is maintained between the housing the sleeve 28 to ensure unencumbered rotation of the internal shafts 16, 26 and sleeve 28 inside the housing 14.

The portion of the second shaft 26 that extends outside the tubular housing 14 reaches into an axial through-bore 30 of the chuck 18 at the second end 14*b* of the housing 14. Within this bore 30, the chuck 18 and second shaft 26 are fixed together for rotation as a single unit, whereby rotation of the external end 16*a* of the input shaft 16 will drive matching rotation of the chuck 18 at the opposing end of the housing 14. As shown, the chuck 18 may be counter-bored to a larger internal diameter at the proximal end 18*a* thereof that faces toward the housing 14 so that the second end of the housing 14*b* fits a short axial distance into this counter-bored end of the chuck 18. Sufficient clearance is provided between the exterior surface of the housing 14 and the interior surface of the counter-bored end of the chuck 18 to allow unencumbered rotation of the chuck 18 relative to the housing 14. As shown, the second end 14*b* of the housing 14 may feature an area of reduced outer diameter relative to the remainder of the housing 14 to contribute to this rotational clearance between the chuck 18 and the housing 14.

Near a distal end 18*b* of the chuck that is located opposite to the housing 14, a threaded radial bore 32 passes through the circumferential wall of the chuck 18 from the exterior thereof into the central axial bore 30 of the chuck. The external end 26*a* of the second axial shaft 26 stops short of reaching the radial bore 32. The brush 20 is of a known commercially available type featuring a twisted-wire central core 34 from which radial bristles 36 emanate outward around the full circumference of the core over the majority of the core's axial length. At an unbristled end of the wire core 34, a cylindrical metal sleeve 38 is fitted onto the wire core 34 and fixed thereto, for example adhesively or by other means, thus forming an end fitting that is slidable into axial bore 30 of the chuck 18 in a close fitting but manually removable manner. The outer diameter of this sleeve-shaped end fitting 38 is of equal to the outer diameter of the internal shafts 16, 26, which may be hollow or solid. Accordingly, the sleeve and shafts have a matching peripheral shape (e.g. cylindrical in the illustrate embodiment) and matching cross-sectional size (e.g. outer diameter of the cylinder).

A set screw 40 is engaged in the threaded radial bore 32 and advanced therein in order to tighten against the sleeve fitting 38 at the connection end of the brush 20 and clamp same against the opposing side of the chuck's internal bore 30, thus securing the end fitting 38 to the chuck 18 in a rotationally fixed position relative thereto, such that the brush will be rotationally driven about the longitudinal axis of its wire core 34 under rotation of the input shaft 16 at the opposite end of the housing 14.

Turning back to the first end 14*a* of the housing 14, an end cap 42 may be externally fitted over this end of the housing. The end cap 42 features a central aperture therein that lies in alignment with the central longitudinal axis of the housing to accommodate passage of the input shaft 16 through the cap 42 in order to place the external end 16*a* of the input shaft in its exposed position outside the housing for engagement by the drill chuck of the cordless drill 100. As the diameter of the input shaft 16 is equal to the outer diameter of the sleeve fitting 38 on the brush 20, the external end 16*a* of the input shaft can alternatively be received in the chuck 18 of another brush device 10 instead of the drill chuck, as demonstrated by FIG. 1, whereby two or more identical shaft assemblies can be assembled end-to-end in series with one another in axially aligned positions to assemble a longer overall brush unit in which the cordless drill 100 engaged to the input shaft at one end of the series is rotatably coupled to the brush 20 installed at the other end of the series.

A stop collar or cross-pin 44 is fixed or releasably locked to the input shaft 16 just outside the cap 42 of the housing 14 at a distance axially spaced from the external end 16*a* of the input shaft in order to limit sliding of the input shaft 16 further into the housing 14. At the other end 14*b* of the housing 14, a similar stop function is provided by an internal shoulder 46 of the chuck 18 that is defined at the transition between the brush-receiving bore 30 at the distal end 18*b* of the chuck and the larger counter-bore at the proximal end 18*a* of the chuck. This shoulder 46 abuts against the respective end 14*b* of the housing 14, thereby preventing the attached second shaft 26 from sliding further into the housing 14. Accordingly, the illustrated embodiment maintains empty space between the internal ends 16*b*, 26*b* of the two internal shafts 16, 26, as sliding together of the two shafts into contact with one another is prevented by these stop features at the opposing ends of the housing to prevent short circuiting of the electrical isolation provided between the shafts by the insulator sleeve 28.

Whether a single brush device 10 or multiple brush devices are used to form the connection between the drill and the brush, electrical isolation between the brush and the hand-carried drill 100 is provided by the sleeve-shaped insulator 28, thereby gaining advantage of the strength and shape-retaining rigidity provided by the use of metal shafts (whether solid shaft, or hollow shafts of reduced weight), and reliability of a metal chuck 18 without exposing the user to risk of electrocution if the wire-core of the brush 20 or the metal chuck 18 should inadvertently come into contact with an electrical wire or other electrical source during use of the brush device 10.

It will be appreciated that similar electrical isolation between the brush and input shaft could be provided in the connection between the brush and input shaft at locations other than at an insulator sleeve coupling the metal input shaft to a second internal metal shaft. For example, it could be possible to employ insulating material around and over the shaft end 26*a* at the second end 14*b* of the housing to isolate this shaft end from the metal chuck 18 and the connection end of the brush 20 engaged therein. In such an embodiment, the use of two separate shafts 16, 26 may not be necessary, with a single internal shaft thus extending from the first external end 16*a* to the second external end 26*a*.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed:

1. A rotational brush apparatus arranged for driven operation by a hand drill, the apparatus comprising:

an electrically non-conductive tubular housing having opposing first and second ends spaced apart in a longitudinal direction and a hollow interior space spanning between said first and second ends and bound by a circumferential wall;

a metal input shaft lying in the longitudinal direction and reaching into the hollow interior space of the tubular housing from the first end thereof to place an internal end of said metal input shaft inside the tubular housing, while leaving an external end of the metal input shaft exposed outside the tubular housing beyond the first end thereof for engagement in a chuck of the hand drill, the metal input shaft shaft being rotatably supported within the tubular housing;

a brush comprising a central core lying parallel to, and in alignment with, the metal input shaft, with bristles of the brush radiating outwardly from said central core at locations outside the tubular housing beyond the second end thereof;

a connection between the metal input shaft and the central core of the brush to cause rotation of the brush with the metal input shaft under driven rotation thereof by the hand drill, the connection being disposed at least partially within the interior space of the tubular housing and comprising an electrical insulator that electrically isolates the metal input shaft from the brush and from any metal portion of the connection that lies externally of the tubular housing beyond the second end thereof.

2. The apparatus of claim 1 wherein the electrical insulator resides at an intermediate location along the tubular housing that is spaced from the second end thereof.

3. The apparatus of claim 2 wherein the electrical insulator resides nearer to a longitudinal mid-point of the tubular housing than to the second end thereof.

4. The apparatus of claim 2 wherein the connection comprises a second metal shaft lying parallel to, and in alignment with, the metal input shaft at a position lying beyond the internal end thereof and reaching toward the second end of the tubular housing, the second metal shaft being rotatably supported within said tubular housing and being coupled to the metal input shaft via the electrical insulator.

5. The apparatus of claim 4 wherein at least a majority of the second metal shaft is contained within the tubular housing.

6. The apparatus of claim 4 wherein the electrical insulator comprises a sleeve of electrically insulative material, opposing ends of which are respectively fitted over the internal end of the metal input shaft and an adjacent end of the second metal shaft, which are spaced apart from one another in the longitudinal direction.

7. The apparatus of claim 1 wherein the electrical insulator comprises a sleeve of electrically insulative material having one end thereof fitted over the internal end of the metal input shaft.

8. The apparatus of claim 7 wherein a second end of the sleeve is fitted over a respective end of a metal component of the connection.

9. The apparatus of claim 1 wherein the connection comprises a chuck arranged for selective detachment and reattachment of the brush thereto.

10. The apparatus of claim 9 wherein the chuck is arranged to enable selective connection thereof to the external end of the metal input shaft of a matching second rotational brush apparatus when the brush is detached from the chuck.

11. The apparatus of claim 9 or 10 wherein the external end of the metal input shaft and a connection end of the brush by which the brush attaches to the chuck have a matching peripheral shape and cross-sectional size.

12. The apparatus of claim 9 wherein the external end of the metal input shaft and a connection end of the brush by which the brush attaches to the chuck have a matching peripheral shape.

13. The apparatus of claim 9 wherein the external end of the metal input shaft and a connection end of the brush by which the brush attaches to the chuck have a matching cross-sectional size.

14. The apparatus of claim 9 wherein the chuck comprises metal and is disposed externally of the tubular housing, and the electrical insulator electrically isolates the chuck from the metal input shaft.

15. The apparatus of claim 1 wherein the central core of the brush comprises metal.

16. The apparatus of claim 15 wherein the central core of the brush comprises twisted metal wire.

17. A rotational brush apparatus arranged for driven operation by a hand drill, the apparatus comprising:

a tubular housing having opposing first and second ends spaced apart in a longitudinal direction and a hollow interior space spanning between said first and second ends and bound by a circumferential wall;

an input shaft lying in the longitudinal direction and reaching into the hollow interior space of the tubular housing from the first end thereof to place an internal end of said input shaft inside the tubular housing, while leaving an external end of the input shaft exposed outside the tubular housing beyond the first end thereof for engagement in a chuck of the hand drill, the input shaft being rotatably supported within the tubular housing;

a brush comprising a central core and bristles radiating outwardly therefrom;

chuck connected to the input shaft for rotation therewith at or adjacent the second end of the tubular housing, the chuck being arranged for selective attachment and detachment to and from an end of the brush, as well as selective attachment and detachment to and from the external end of the input shaft of a second matching rotational brush apparatus.

18. The apparatus of claim 17 wherein the external end of metal input shaft and a connection end of the brush by which the brush attaches to the chuck have a matching peripheral shape.

19. The apparatus of claim 17 wherein the external end of metal input shaft and a connection end of the brush by which the brush attaches to the chuck have a matching cross-sectional size.

20. The apparatus of claim 17 wherein the external end of metal input shaft and a connection end of the brush by which the brush attaches to the chuck have a matching peripheral shape and cross-sectional size.

* * * * *